US006053820A

United States Patent [19]

Kasashima et al.

[11] Patent Number: 6,053,820

[45] Date of Patent: Apr. 25, 2000

[54] GOLF BALL

[75] Inventors: Atsuki Kasashima; Keisuke Ihara; Hirotaka Shimosaka, all of Chichibu, Japan

[73] Assignees: Bridgestone Corporation; Sports Co., Ltd., both of Tokyo, Japan

[21] Appl. No.: 09/136,296

[22] Filed: Aug. 19, 1998

[30] Foreign Application Priority Data

Aug. 19, 1997 [JP] Japan ..... 9-236496

[51] Int. Cl.[7] ..... A63B 37/14

[52] U.S. Cl. ..... 473/378; 473/384

[58] Field of Search ..... 473/384, 378, 473/379, 380, 381, 382, 383

[56] References Cited

U.S. PATENT DOCUMENTS 4,681,323 7/1987 Alaki et al. ..... 273/DIG. 22

*Primary Examiner*—Sebastiano Passaniti

*Attorney, Agent, or Firm*—Sughrue, Mion, Zinn, Macpeak & Seas, PLLC

[57] ABSTRACT

In a golf ball having a multiplicity of dimples of circular plane shape disposed at a spacing on its surface, dimple spacings of up to 1.65 mm account for 60 to 80% of the entire dimple spacings, and an average $V_0$ and A, defined in the specification, are limited. The shape and arrangement of dimples are correlated so that dimples may be distributed on the ball surface in a well-balanced uniform arrangement, whereby the flight behavior is drastically improved.

6 Claims, 9 Drawing Sheets

AN ARRANGEMENT OF DIMPLES IS REGULAR OCTAHEDRON

AN ARRANGEMENT OF DIMPLES IS REGULAR OCTAHEDRON

A GOLF BALL OF EXAMPLE 2

GOLF BALL

This invention relates to a golf ball having a multiplicity of dimples distributed on its surface in a good balance enough to provide excellent flight performance.

BACKGROUND OF THE INVENTION

In general, golf balls are provided with a multiplicity of a dimples of circular plane shape on their surface for the purpose of improving their aerodynamic properties. It is well known that the dimpled golf balls are far better in flight behavior than smooth golf balls devoid of dimples.

The flight distance of golf balls depends on the initial velocity, drag and lift acting on the ball during flight, spin rate, and other factors such as weather conditions. It is considered difficult to make theoretical analysis on golf balls with the aim of increasing their flight distance.

For improving the flight performance of the ball except for the initial velocity which is largely governed by the material of the ball, a number of attempts of directed toward tailoring dimples relating to the geometrical factors of the ball have been made. Such attempts include, for example, increasing the diameter of dimples, increasing or decreasing the depth of dimples, changing the shape of dimples from circular one to polygonal and other shapes, and increasing or decreasing the number of dimples.

There is still a demand to develop golf balls whose flight performance is satisfactory for the high skill level of professional and equivalent golfers.

SUMMARY OF THE INVENTION

An object of the invention is to provide a golf ball having dimples on its surface, wherein aerodynamic properties are improved by optimizing the arrangement of dimples relative to their shape.

According to the invention, there is provided a golf ball having a multiplicity of dimples of substantially circular plane shape disposed at a spacing on its surface. Dimple spacings of up to 1.65 mm account for 60% to 80% of the entire dimple spacings. An average of $V_0$ values associated with the dimples is 0.4 to 0.55. $V_0$ is the volume of space in a dimple below a planar surface circumscribed by the edge of the dimple divided by the volume of a cylinder whose base is the planar surface and whose height is the maximum depth of the dimple from the base. The value of A is in the range: $11.5<A<12.5$, provided that A is given by the equation:

$$A=21.3461-0.00466N-1.4255DM-13.93DP$$

wherein N is the total number of dimples, DM is an average diameter (mm) of dimples, and DP is an average depth (mm) of dimples. Preferably, the dimples have an edge angle in the range of 1° to 30°.

When the proportion of dimple spacings of 1.65 mm or less is 60% to 80% of the entire dimple spacings, the average of $V_0$ values representative of the spatial factor of dimples is 0.4 to 0.55, A is in the range: $11.5<A<12.5$, and preferably, the dimples have an edge angle in the range of 1° to 30°, not only the dimple shape is optimized, but the dimples are distributed on the ball surface in a well-balanced uniform arrangement, so that the trajectory of the ball is optimized. Then the flight behavior of the ball is drastically improved to such an extent that skilled golfers and even professional golfers may be fully satisfied.

DETAILED DESCRIPTION OF THE INVENTION

Figure 1:
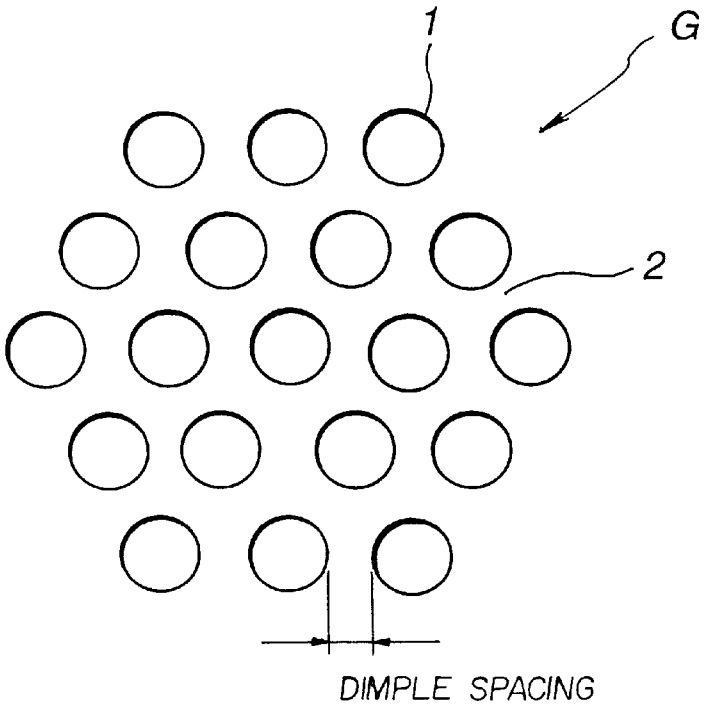
FIG. 1 is an enlarged plan view of a portion of a dimpled golf ball surface according to one embodiment of the invention.

As shown in FIG. 1, the golf ball of the invention, generally designated at G, has a multiplicity of spaced-apart dimples 1 of circular plane shape on its surface. The spherical surface of the golf ball G excluding the dimples is depicted as a land 2. According to the invention, the shape of dimples is optimized, and a multiplicity of dimples are distributed on the ball surface in a well-balanced uniform arrangement so that the flight behavior of the ball may be improved.

In the present invention, the dimple spacing, $V_0$, A and edge angle are defined as follows.

Dimple spacing

The spacing between dimples is determined on the basis of reference points, which also serve as a basis for determining the diameter DM of a dimple.

Figure 2:
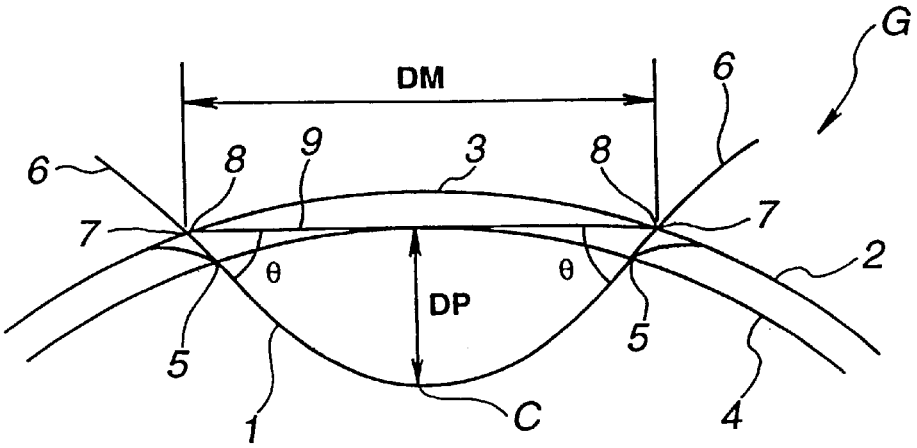
FIG. 2 is a schematic cross-sectional view of a dimple.

The cross-section of FIG. 2, viewed radially with respect to the ball center, passes the center C of a dimple 1. A land surface contour curve 3 consisting of the land 2 surface and an imaginary extension thereof (representing an imaginary spherical surface having the diameter of the ball) and an imaginary curve 4 spaced 0.04 mm inside from the contour curve 3 (or spherical surface having a radius 0.04 mm smaller than the ball radius) are drawn in conjunction with the dimple 1. The inside curve 4 intersects the dimple 1 at two points 5. The tangents 6 to the dimple 1 at these points 5, extended outward, intersect the contour curve 3 at reference points 7. The straight line segment between reference points 7 and 7 is the diameter DM of the dimple.

Figure 3:
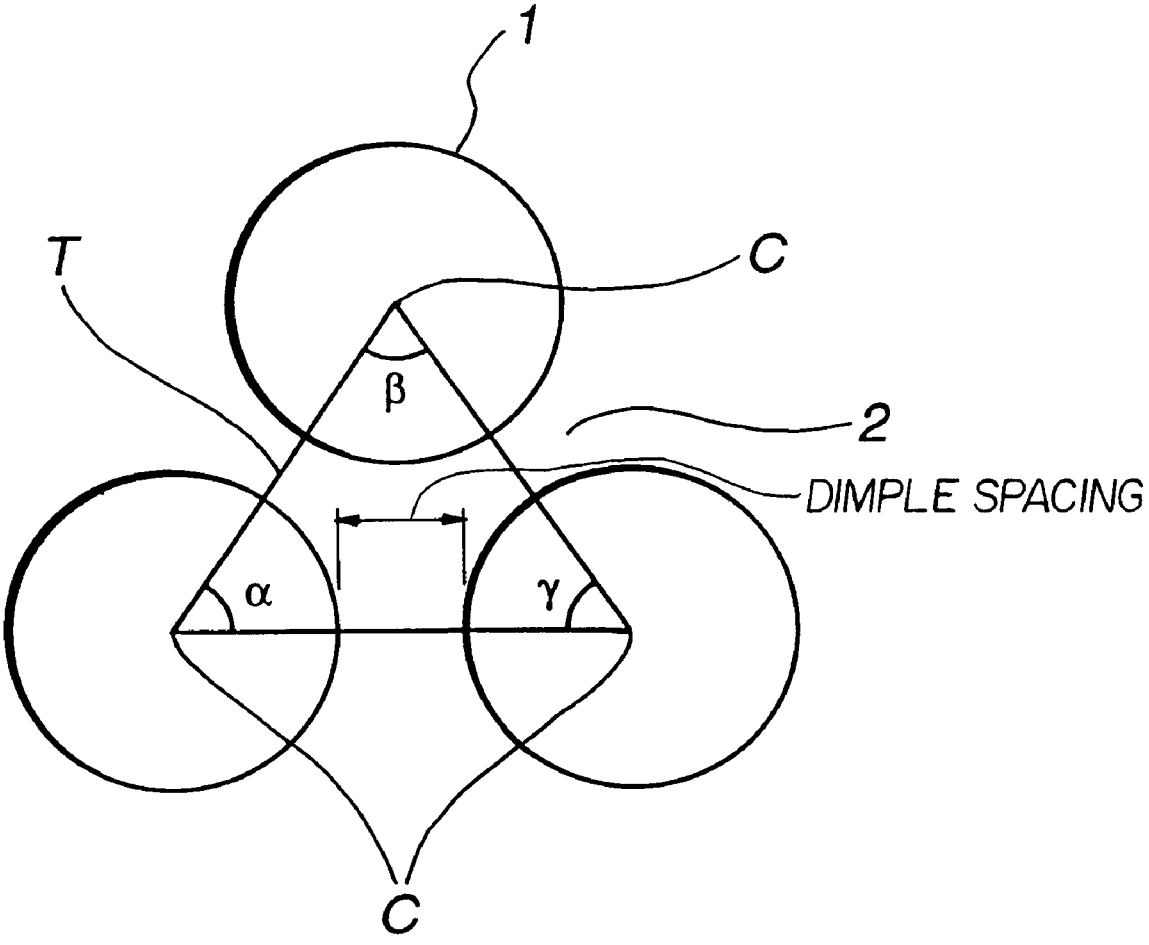
FIG. 3 is an enlarged plan view, similar to FIG. 1, of three dimples for illustrating the spacing between dimples.

Then, three dimples 1 are arbitrarily chosen from the ball surface as shown in FIG. 3. An imaginary spherical triangle T having apexes each at the center C of one dimple is drawn. These three dimples are regarded as being in an "adjacent relationship" when (A) the three included angles $\alpha$, $\beta$ and $\gamma$ of the imaginary spherical triangle T each are greater than 30°, and (B) no other dimples are situated within or on the sides of the imaginary spherical triangle T.

For these dimples in the "adjacent relationship," the spacing between dimples is determined as the distance between reference points 7, that is, the distance of the minimum land between dimples.

Definition of $V_0$

The dimple cross-sectional shape coefficient $V_0$ is the volume of space in a dimple below a planar surface circumscribed by the edge of the dimple divided by the volume of a cylinder whose base is the planar surface and whose height is the maximum depth of the dimple from the base. An average $V_0$ is given by averaging the $V_0$ values of all dimples.

Figure 4:
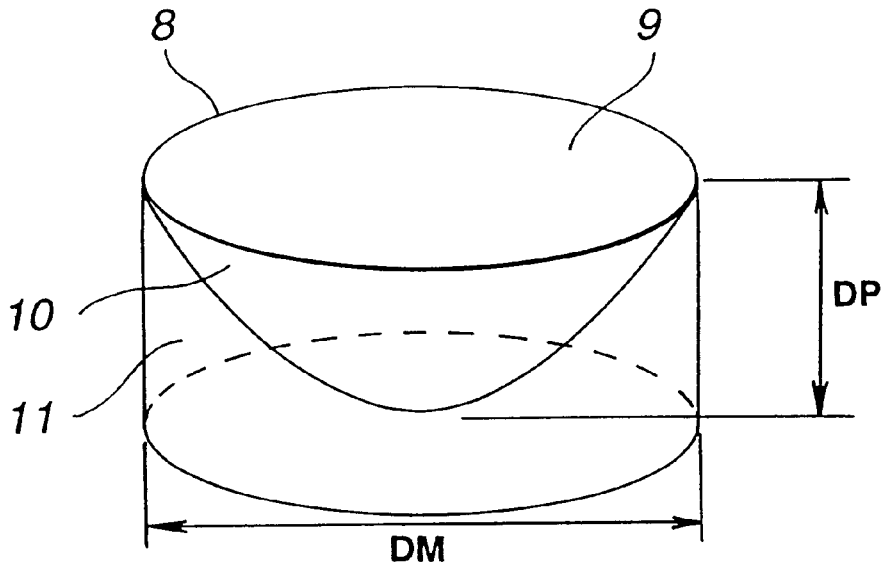
FIG. 4 is a perspective view of the same dimple as in FIG. 2 illustrating how to calculate $V_0$.
Figure 5:
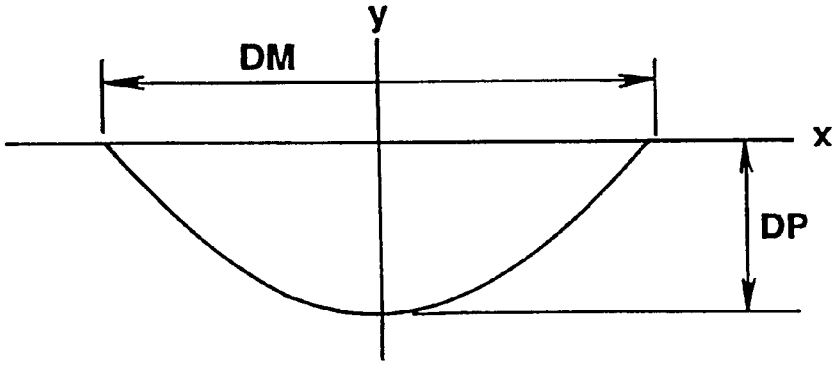
FIG. 5 is a cross-sectional view of the same dimple as in FIG. 2.
Figure 6:
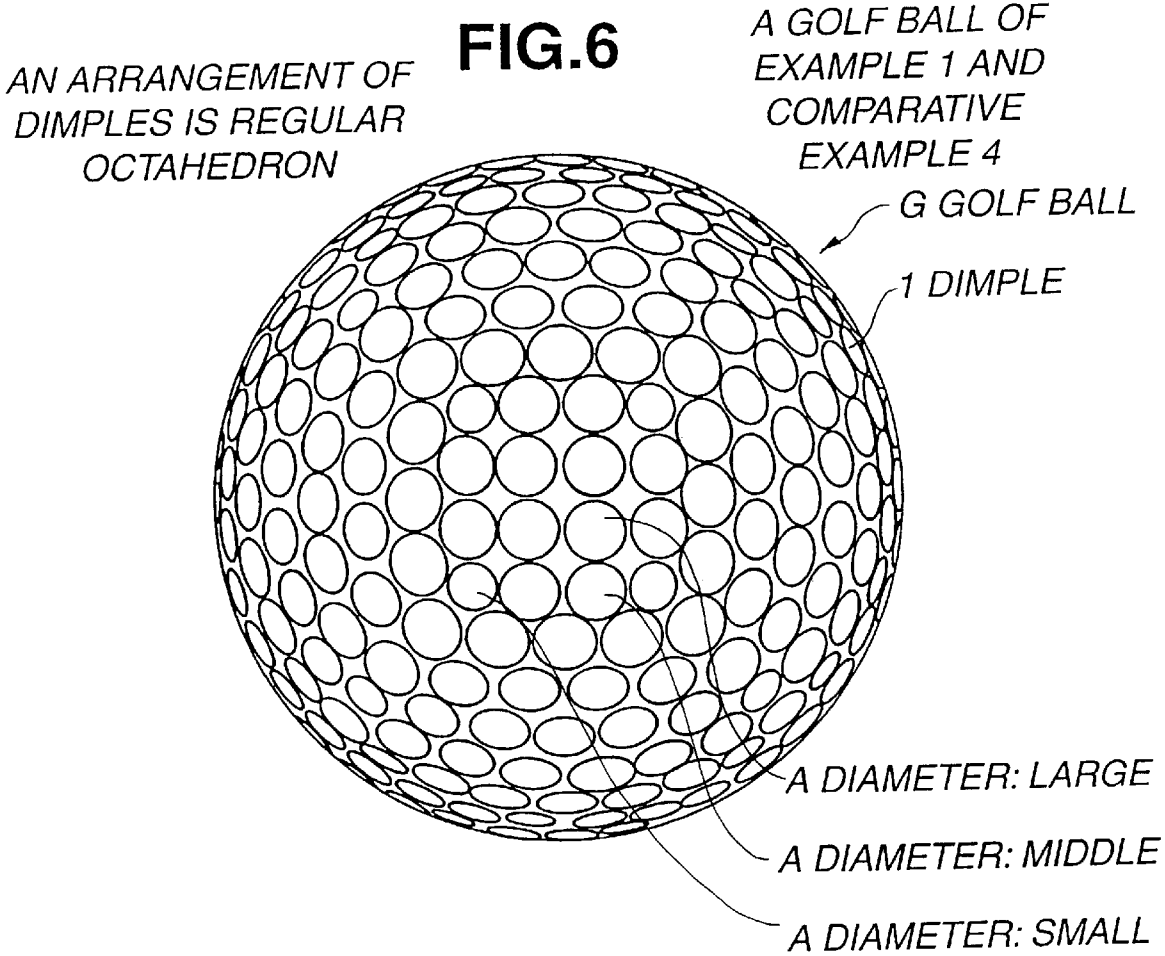
FIG. 6 illustrates an arrangement pattern of dimples on the golf balls of Example 1 and Comparative Example 4.
Figure 7:
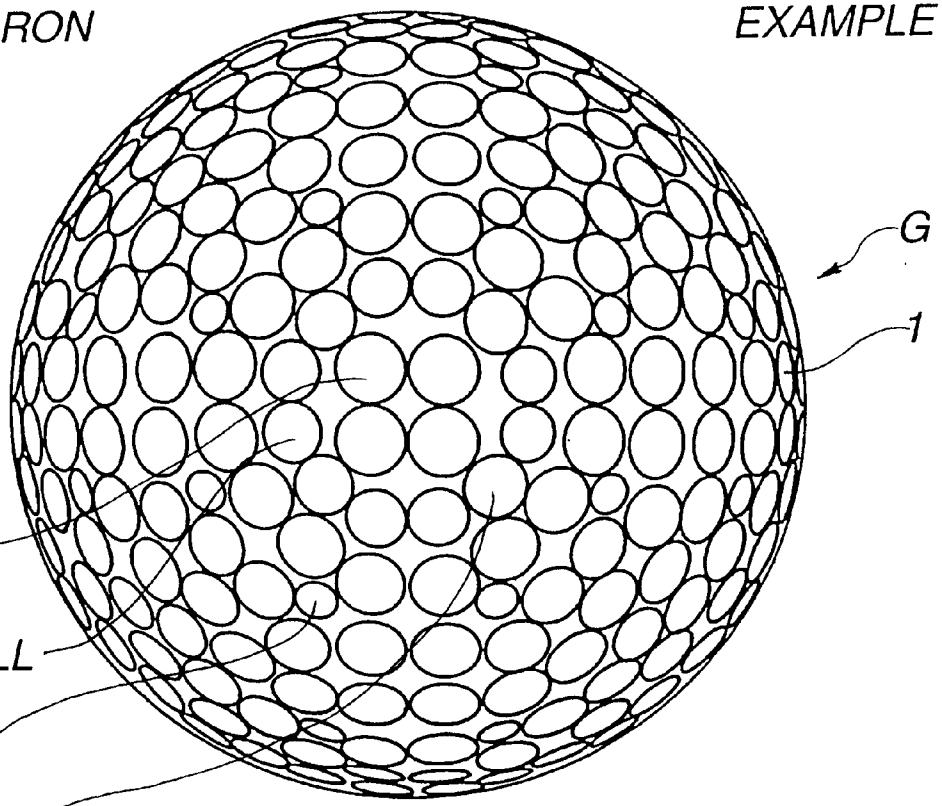
FIG. 7 illustrates an arrangement pattern of dimples on the golf ball of Example 2.
Figure 8:
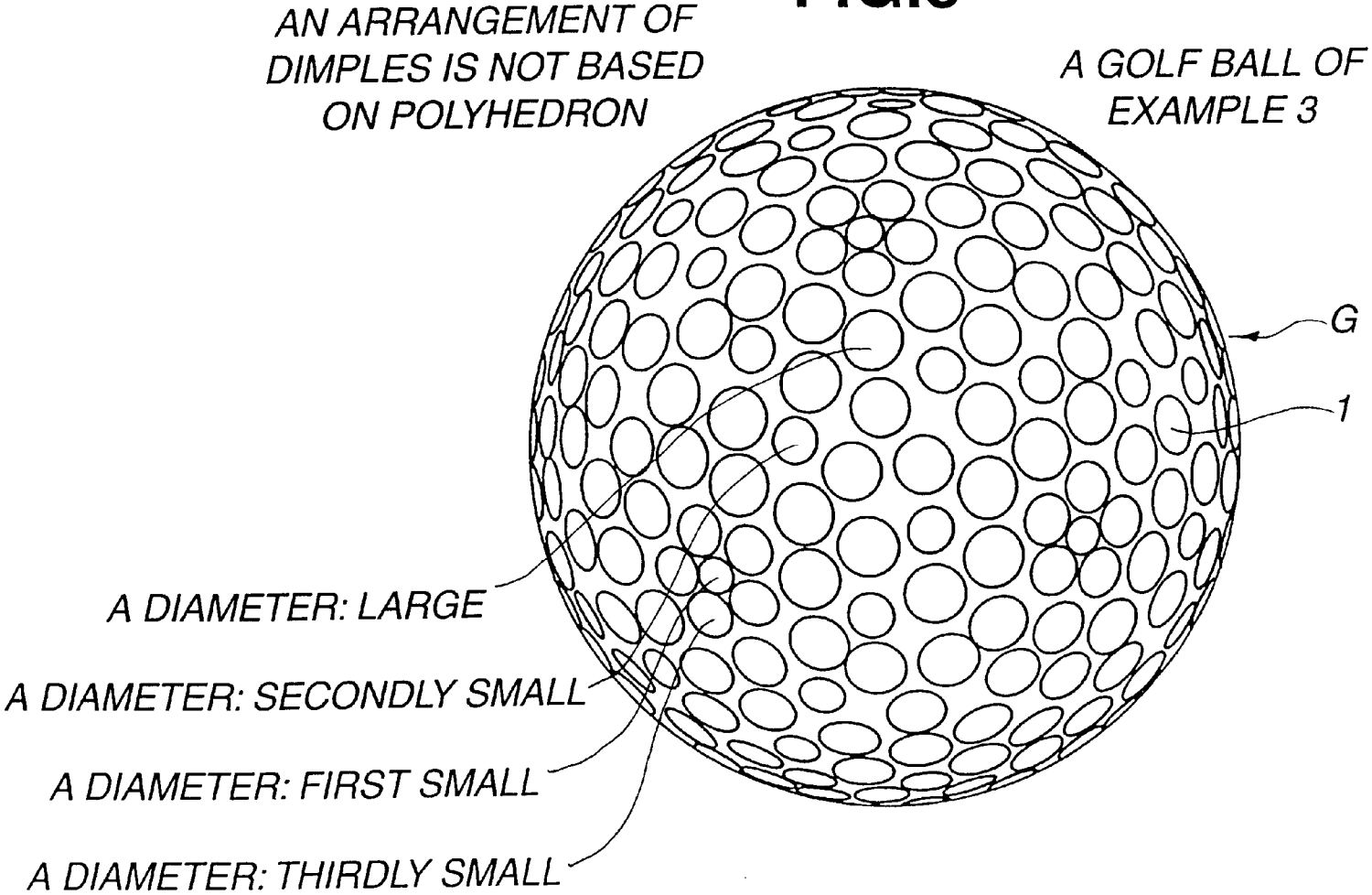
FIG. 8 illustrates an arrangement pattern of dimples on the golf ball of Example 3.
Figure 9:
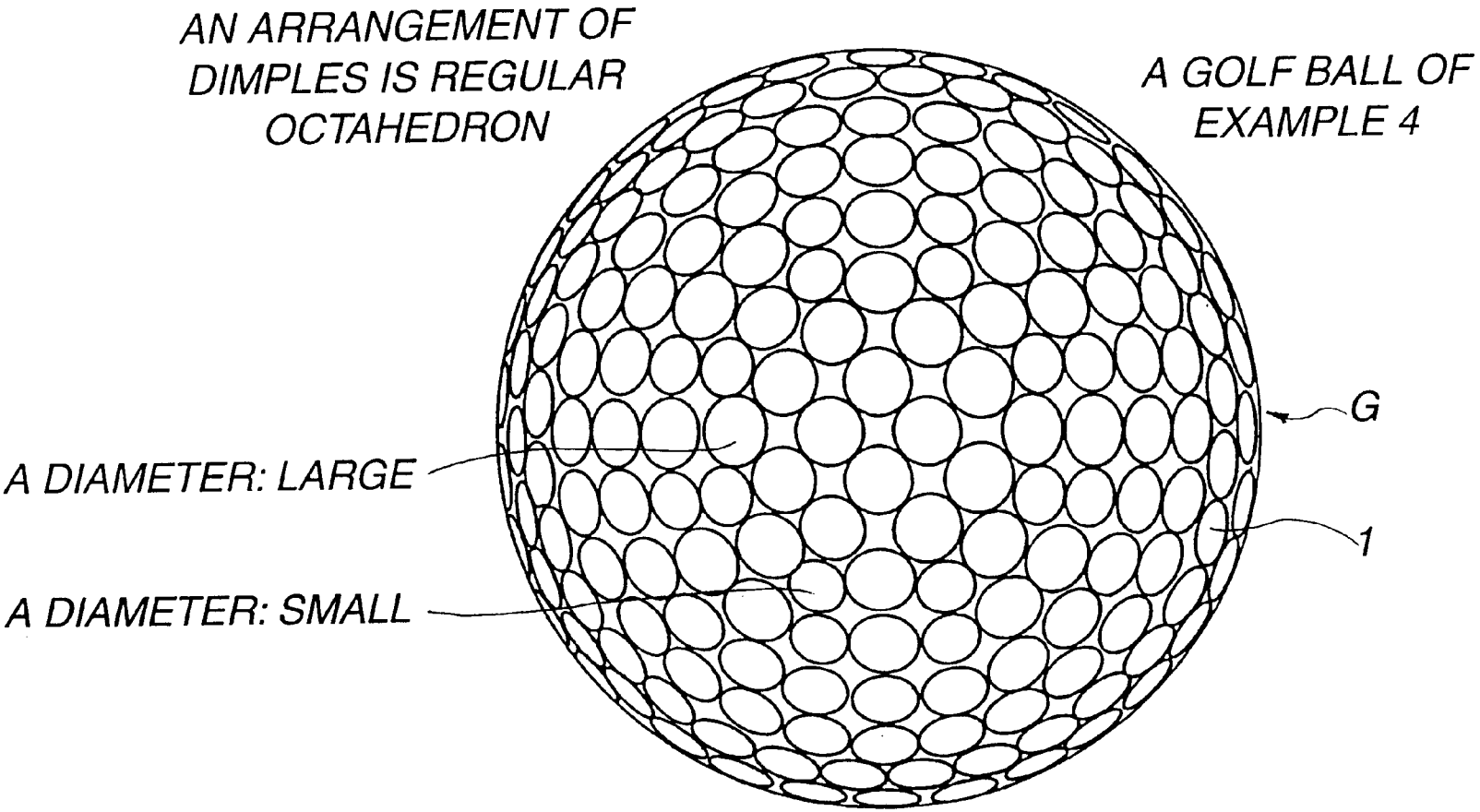
FIG. 9 illustrates an arrangement pattern of dimples on the golf ball of Example 4.
Figure 10:
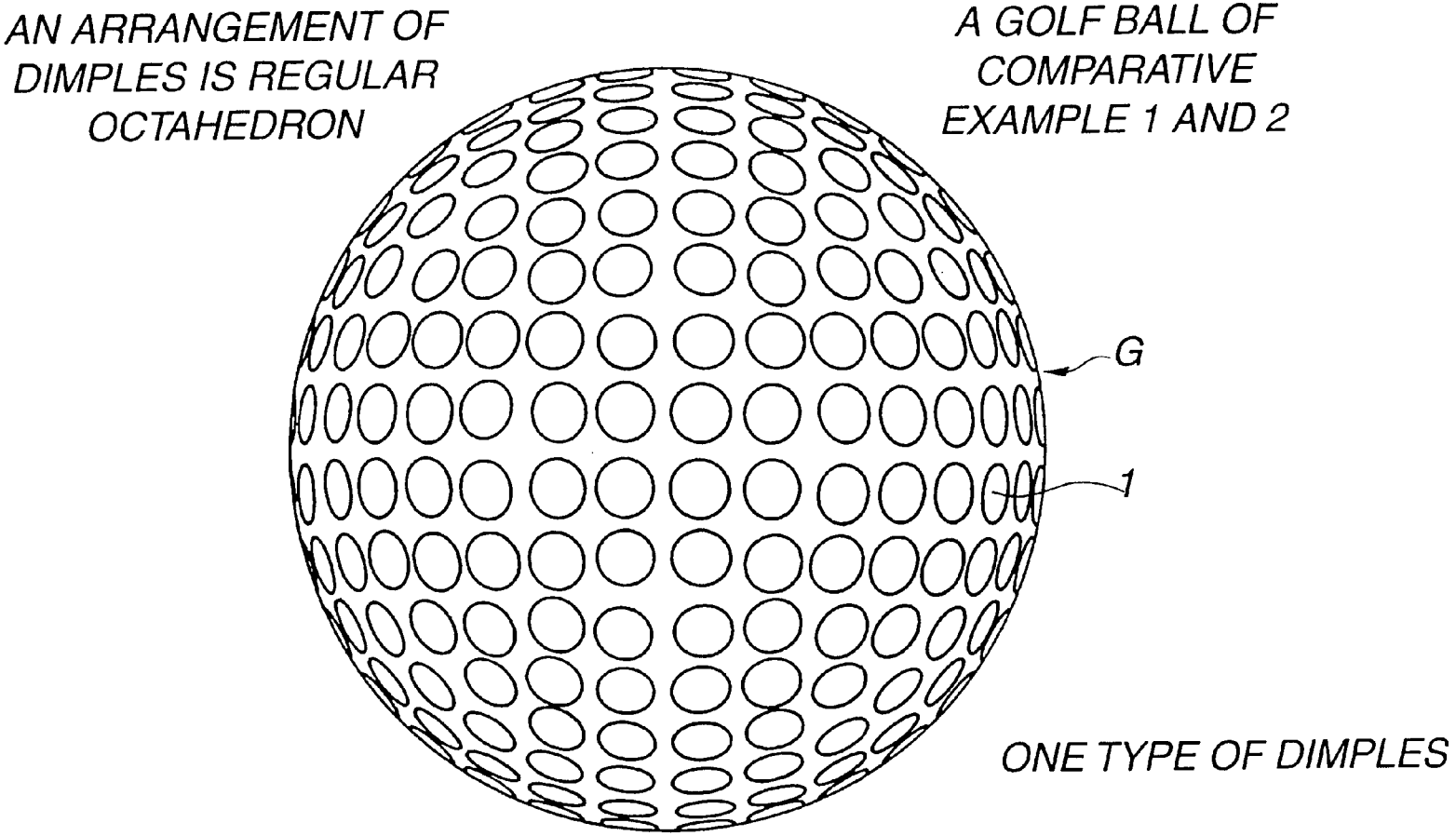
FIG. 10 illustrates an arrangement pattern of dimples on the golf balls of Comparative Examples 1 and 2.
Figure 11:
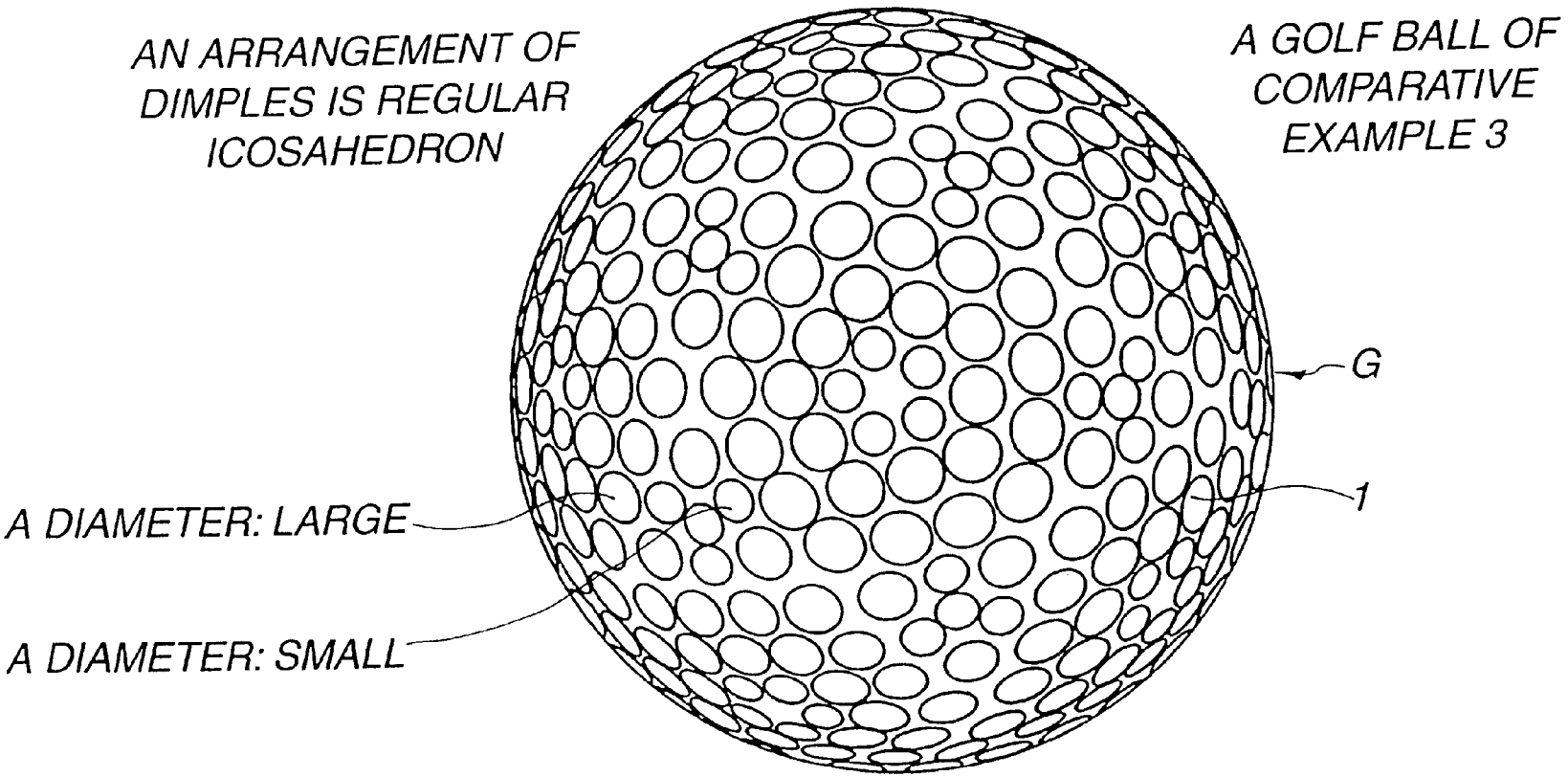
FIG. 11 illustrates an arrangement pattern of dimples on the golf ball of Comparative Example 3.

Referring to FIG. 2 again, a series of reference points 7 defines the dimple edge 8. The dimple edge 8 is so defined for the reason that the exact position of the dimple edge cannot be otherwise determined because the actual edge of a dimple 1 is generally rounded. As shown in FIGS. 4 and 5, the dimple edge 8 circumscribes a planar surface 9 (a circle having the diameter DM). The dimple space 10 below this planar surface 9 has a volume Vp which is calculated using the equation shown below. A cylinder 11 whose base is the planar surface 9 and whose height is the maximum depth DP of the dimple from this planar surface 9 or base has a volume Vq which is calculated using the equation shown below. The $V_0$ value is obtained by calculating the ratio of the dimple space volume Vp to the cylinder volume Vq.

$$Vp = \int_0^{\frac{DM}{2}} 2\pi xy\,dx$$

$$Vq = \frac{\pi DM^2 DP}{4}$$

$$V_0 = Vp / Vq$$

Definition of $A$ $A$ is given by the equation:

$$A = 21.3461 - 0.00466N - 1.4255DM - 13.93PD.$$

Herein N is the total number of dimples, DM is an average diameter (mm) of dimples, and DP is an average depth (mm) of dimples.

The A value is a measure for estimating the angle between the line of sight given when the ball is visually tracked by the eyes and the horizontal line, that is, the maximum angle of the ball trajectory, when a player strikes the ball with a club intended for distance, typically a driver. An actual drive test has revealed that the A value has a reference value of 12. When the value of A is greater than 12, the ball rises relatively high, traveling a trajectory leading to a longer carry. When the value of A is less than 12, the ball flies relatively low, traveling a trajectory leading to a longer run.

Edge angle

The edge angle is, as shown in FIG. 2, the angle θ between tangent 6 at intersection 5 and the straight line segment between reference points 7 and 7 (or planar surface 9 circumscribed by dimple edge 8).

According to the invention, dimple spacings of up to 1.65 mm (that is, narrow dimple spacings) account for 60 to 80% of the entire dimple spacings, and preferably 65 to 75% of the entire dimple spacings. With such dimple spacing, dimples can be distributed on the finite ball surface in a most effective, well-balanced manner. If the proportion of narrow dimple spacings is less than 60%, the lands between dimples become wider, resulting in a sparse dimple distribution and hence, poor flight performance. If the same proportion is more than 80%, it is unavoidable that adjacent dimples overlap each other at more positions, also adversely affecting the flight performance.

Secondly, the spatial factor of dimples is optimized. That is, an average of $V_0$ values for all the dimples is in the range of 0.4 to 0.55. Additionally, the edge angle of dimples is preferably 1° to 30°, and more preferably 5° to 20°.

Thirdly, A as defined above is in the range: 11.5<A<12.5, preferably from 11.7 to 12.3. By adjusting A in this range, the ball will follow an optimum trajectory rather than too high or low trajectories. With A falling in this range, the average dimple diameter DM is 2 to 5 mm, the average dimple depth DP is 0.05 to 0.30 mm, and the total number N of dimples is 300 to 600. The shape of dimples is substantially circular in plane shape. The type of dimples is not particularly limited although it is preferred that there are formed at least two, preferably two to five types of dimples which are different in diameter and/or depth.

According to the invention, by adjusting the spacing between dimples to fall in the desired range and optimizing the spatial factor of dimples, the trajectory of the ball is optimized. Since the shape of dimples is correlated to the arrangement of dimples, a multiplicity of dimples can be distributed on the ball surface in a well-balanced, mostly equi-spaced relationship, achieving a drastic improvement in flight performance.

In the golf balls of the invention, no particular limits are imposed on the ball structure. The balls may be prepared from well-known materials to solid golf balls including one-piece golf balls, two-piece golf balls and multi-piece golf balls having a three or more layer structure as well as wound golf balls.

EXAMPLE

Examples of the invention are given below by way of illustration and not by way of limitation.

Examples 1–4 and Comparative Examples 1–4

Two-piece solid golf balls were prepared in a conventional manner using well-known materials. On the surface of these golf balls, dimples whose parameters are shown in Table 1 were distributed in the arrangements shown in FIGS. 6 to 11.

These golf balls were determined for the proportion of dimple spacings of up to 1.65 mm, $V_0$, and A. The results are shown in Table 1.

Next, using a swing robot, the golf balls were struck with a driver at a head speed of 45 m/sec. A carry and a total distance were measured. The results are shown in Table 2.

TABLE 1

| | Example | | | | Comparative Example | | | |
|---|---|---|---|---|---|---|---|---|
| | 1 | 2 | 3 | 4 | 1 | 2 | 3 | 4 |
| Dimple Type | | | | | | | | |
| Diameter (mm) | 3.88 | 3.75 | 3.71 | 3.80 | 3.34 | 3.34 | 3.20 | 3.88 |
| Depth (mm) | 0.190 | 0.180 | 0.220 | 0.138 | 0.250 | 0.200 | 0.155 | 0.230 |
| Number | 112 | 224 | 252 | 344 | 336 | 336 | 360 | 112 |
| Diameter (mm) | 3.68 | 3.50 | 3.10 | 3.30 | | | 2.50 | 3.68 |
| Depth (mm) | 0.173 | 0.165 | 0.180 | 0.115 | | | 0.130 | 0.205 |
| Number | 224 | 120 | 60 | 48 | | | 140 | 224 |
| Diameter (mm) | 3.15 | 3.15 | 2.70 | | | | | 3.15 |
| Depth (mm) | 0.168 | 0.142 | 0.150 | | | | | 0.168 |
| Number | 64 | 48 | 48 | | | | | 64 |
| Diameter (mm) | | 2.35 | 2.30 | | | | | |
| Depth (mm) | | 0.110 | 0.130 | | | | | |
| Number | | 48 | 12 | | | | | |

TABLE 1-continued

| | Example | | | | Comparative Example | | | |
|---|---|---|---|---|---|---|---|---|
| | 1 | 2 | 3 | 4 | 1 | 2 | 3 | 4 |
| Total Number | 400 | 440 | 372 | 392 | 336 | 336 | 500 | 400 |
| Av. Diameter (mm) | 3.65 | 3.46 | 3.44 | 3.74 | 3.34 | 3.34 | 3.00 | 3.65 |
| Av. Depth (mm) | 0.177 | 0.164 | 0.202 | 0.135 | 0.250 | 0.200 | 0.148 | 0.206 |
| A | 11.81 | 12.07 | 11.91 | 12.31 | 11.54 | 12.23 | 12.67 | 11.41 |
| Av. $V_0$ | 0.48 | 0.47 | 0.47 | 0.46 | 0.38 | 0.45 | 0.52 | 0.47 |
| Dimple spacings ≦ 1.65 mm* (%) | 71.2 | 72.4 | 67.3 | 68.5 | 54.9 | 54.9 | 59.6 | 71.2 |
| Dimple arrangement | FIG.6 | FIG.7 | FIG.8 | FIG.9 | FIG. 10 | FIG. 10 | FIG. 11 | FIG.6 |

*the proportion of dimple spacings of up to 1.65 mm in the entire dimple spacings

TABLE 2

| | Example | | | | Comparative Example | | | |
|---|---|---|---|---|---|---|---|---|
| | 1 | 2 | 3 | 4 | 1 | 2 | 3 | 4 |
| Flight distance | | | | | | | | |
| Carry (m) | 210 | 212 | 211 | 213 | 198 | 209 | 203 | 204 |
| Total (m) | 224 | 226 | 226 | 224 | 211 | 215 | 214 | 220 |

There has been described the dimpled golf ball wherein the shape and arrangement of dimples are correlated so that the dimples may be distributed on the ball surface in a well-balanced uniform arrangement, whereby the flight behavior is drastically improved.

Although some preferred embodiments have been described, many modifications and variations may be made thereto in light of the above teachings. It is therefore to be understood that the invention may be practiced otherwise than as specifically described without departing from the scope of the appended claims.

We claim:

1. A golf ball comprising: two to five types of dimples of substantially circular plane shape on its surface which are different in either one or both of diameter depth, wherein three dimples are arbitrarily chosen from the ball surface when an imaginary spherical triangle having apexes each at the center of one dimple is drawn, three included angles $\alpha$, $\beta$ and $\tau$ of the imaginary spherical triangle each are greater than 30°, and no other dimples are situated within or on the sides of the imaginary spherical triangle, dimple spacings of up to 1.65 mm account for 60 to 80% of the entire dimple spacings, said dimples have an average $V_0$ value of 0.46 to 0.55, where $V_0$ is the value of space in a dimple below a planar surface circumscribed by the edge of the dimple divided by the volume of a cylinder whose base is the planar surface and whose height is the maximum depth of the dimple from the base, and A is in the range: $11.5<A<12.5$, where:

$A=21.3461-0.00466N-1.4255DM-13.93DP$ wherein N is the total number of dimples,

DP is an average depth (mm) of dimples and

DM is an average depth (mm) of dimples.

2. The golf ball of claim 3 wherein the dimples have an edge angle in the range of 1° to 30°.

3. The golf ball of claim 1, wherein an edge angle of dimples is dimples 5° to 20.

4. The golf ball of claim 1, wherein the dimple spacings of up to 1.65 mm account for 65 to 75% of the entire dimple spacings.

5. The golf ball of claim 1, wherein the average dimple diameter DM is 2 to 5 mm.

6. The golf ball of claim 1, wherein the average dimple depth DP is 0.05 to 0.30 mm.

* * * * *

UNITED STATES PATENT AND TRADEMARK OFFICE

CERTIFICATE OF CORRECTION

PATENT NO. : 6,053,820
DATED : April 25, 2000
INVENTOR(S) : Atsuki Kasashima et al.

It is certified that error appears in the above-identified patent and that said Letters Patent is hereby corrected as shown below:

Title page,
Item [73], Assignee, delete "Bridgestone Corporation; Sports Co., Ltd., both of Tokyo, Japan" and insert -- Bridgestone Sports Co., Ltd., Tokyo, Japan --.

Signed and Sealed this

Fifth Day of November, 2002

*Attest:*

*Attesting Officer*

JAMES E. ROGAN
*Director of the United States Patent and Trademark Office*